US009199148B2

(12) United States Patent
Krohl et al.

(10) Patent No.: US 9,199,148 B2
(45) Date of Patent: Dec. 1, 2015

(54) APPARATUS FOR IMPROVING THE ACCURACY OF SHOTS ON GOAL

(76) Inventors: Robert Krohl, Brighton, MI (US); James Krohl, Milan, MI (US)

( * ) Notice: Subject to any disclaimer, the term of this patent is extended or adjusted under 35 U.S.C. 154(b) by 139 days.

(21) Appl. No.: 13/569,709

(22) Filed: Aug. 8, 2012

(65) Prior Publication Data

US 2014/0045628 A1 Feb. 13, 2014

(51) Int. Cl.
*A63B 69/00* (2006.01)
*A63B 63/00* (2006.01)

(52) U.S. Cl.
CPC ..... *A63B 63/00* (2013.01); *A63B 69/0026* (2013.01); *A63B 69/0097* (2013.01); *A63B 63/004* (2013.01); *A63B 2102/14* (2015.10); *A63B 2102/22* (2015.10); *A63B 2209/00* (2013.01); *A63B 2220/803* (2013.01); *A63B 2220/833* (2013.01); *A63B 2243/005* (2013.01); *A63B 2243/0025* (2013.01); *A63B 2243/0041* (2013.01)

(58) Field of Classification Search
USPC ..... 473/478, 446; 273/400; 160/124
See application file for complete search history.

(56) References Cited

U.S. PATENT DOCUMENTS

| | | | | | |
|---|---|---|---|---|---|
| 2,588,256 | A | * | 3/1952 | Lepow | 160/124 |
| 2,750,596 | A | * | 6/1956 | Amado | 160/387 |
| 3,197,208 | A | | 7/1965 | Makar | |
| 3,856,298 | A | | 12/1974 | Frantti | |
| 3,944,223 | A | | 3/1976 | Bromwell | |
| 4,607,842 | A | | 8/1986 | Daoust | |
| 4,842,283 | A | | 6/1989 | LeBel et al. | |
| 4,921,257 | A | | 5/1990 | Heller | |
| 4,948,147 | A | | 8/1990 | Pallanca | |
| 5,141,226 | A | * | 8/1992 | Cavanagh | 473/460 |
| 5,238,243 | A | | 8/1993 | Grispi | |
| 5,271,624 | A | * | 12/1993 | Sciortino | 473/446 |
| 5,277,430 | A | * | 1/1994 | Naccarato | 473/446 |
| 5,421,586 | A | * | 6/1995 | Amram et al. | 273/400 |
| 5,628,515 | A | | 5/1997 | Levy | |
| 5,634,640 | A | | 6/1997 | McCarrel | |
| 5,725,444 | A | | 3/1998 | Heden | |
| 5,888,153 | A | | 3/1999 | Masin | |
| 5,895,330 | A | | 4/1999 | Reilly, Jr. | |
| 5,902,194 | A | * | 5/1999 | Wade | 473/446 |

(Continued)

FOREIGN PATENT DOCUMENTS

| | | | |
|---|---|---|---|
| CA | 1057325 | A1 | 6/1979 |
| CA | 1070346 | A1 | 1/1980 |

(Continued)

*Primary Examiner* — Gene Kim
*Assistant Examiner* — M Chambers
(74) *Attorney, Agent, or Firm* — Gifford, Krass, Sprinkle, Anderson & Citkowski, P.C.

(57) ABSTRACT

A sports goal target uses a visual barrier to train and develop a psychological mind set to improve shooting accuracy during practice and subsequent games. The barrier has an upper edge corresponding to the length of the upper member of the goal and two side edges having a length corresponding to the length of the side members of the goal. The inner edge is spaced apart from the outer edge to define a width, and a plurality of fasteners for attaching the barrier just inside the goal. The barrier may be composed of a flexible material or rigid or semi-rigid panels. The barrier is colored with a bright or fluorescent color intended for players to remember after the barrier is removed for practice without the barrier or a real game. The barrier may be sized for various games, with the dimensions being varied to suit the particular sport.

11 Claims, 3 Drawing Sheets

(56) References Cited

U.S. PATENT DOCUMENTS

| | | | | |
|---|---|---|---|---|
| 6,695,724 | B2 | 2/2004 | Birss | |
| 6,926,624 | B1 | 8/2005 | Witzke | |
| D537,489 | S | 2/2007 | McAdams et al. | |
| 7,252,604 | B2 | 8/2007 | Birss | |
| 8,052,545 | B1 | 11/2011 | Assenheimer, III | |
| 8,109,845 | B2 | 2/2012 | Duty | |
| 2001/0006074 | A1* | 7/2001 | Zheng | 135/126 |
| 2008/0076606 | A1* | 3/2008 | Siefker | 473/446 |
| 2014/0045628 | A1* | 2/2014 | Krohl et al. | 473/446 |

FOREIGN PATENT DOCUMENTS

| | | | |
|---|---|---|---|
| CA | 1202045 | A1 | 3/1986 |
| CA | 2141396 | A1 | 6/1996 |
| CA | 2152727 | A1 | 12/1996 |
| CA | 2168200 | A1 | 7/1997 |
| CA | 2216412 | A1 | 3/1999 |
| CA | 2244033 | A1 | 1/2000 |
| CA | 2418570 | A1 | 10/2003 |

* cited by examiner

APPARATUS FOR IMPROVING THE ACCURACY OF SHOTS ON GOAL

FIELD OF THE INVENTION

This invention relates generally to sports training aids and, in particular, to a target device that helps the shooter see the open areas of a goal in greater detail.

BACKGROUND OF THE INVENTION

There are numerous devices intended to improve a shooter's accuracy in many sports, including hockey. However, most practice targets are used without a goaltender and only provide a visual target in the corners of the goal or between the goaltender's legs. An early example is shown in U.S. Pat. No. 3,856,298. For the shooting phase of the game, a barricade member 18 is provided, as shown in detail in FIG. 1, for attachment to the goal 17 as a means of blocking entry into the net 20. The barricade 18 includes a panel 23 having one or more openings 19 in the panel plywood 23 to allow a hockey puck to pass through the barricade 18 to the interior of the goal 17. The barricade member 18 is provided with attachment means to allow the barricade member 18 to be attached to the goal 17 at the frame 24 which surrounds the opening into the net 20. The openings 19 in the barricade 18 are each of a size sufficient to allow a puck to pass through the opening 19 into the net 20 and the openings 19 are preferably positioned on the panel 23 of the barricade 18 so as to conform to locations at which a puck could reasonably be expected to enter the net 20 if a goalie were actually protecting the goal.

Other practice aids are not intended for use with a regulation goal at all. For example, U.S. Pat. No. 3,944,223 discloses a hockey type goal structure which may be readily set up in a yard, street or on ice. The goal is formed of a rectangular frame that supports a canvas sheet fitted with peripheral openings in a plane generally inclined to the horizontal surface on which the device is mounted. The canvas sheet is fastened by tension springs to a frame so that a ball or puck striking the canvas is rebounded away from the structure, while a ball or puck entering one of the peripheral openings is scored as a goal. While the structure does feature surfaces around the peripheral opening of a goal, the goal forms part of a game unto itself and, unlike a real game of hockey, central shots are favored over corner shots.

Various practice aids are also commercially available (See, for example, http://www.hockeyshot.com/Shooting_Targets_Tarps_s/72.htm). So-called "shooter tutor" target panels fasten over an existing real goal, and typically provide a picture of a goalie with holes through the target in the corners and between the goalie's legs. While the ultimate scoring regions are defined by the holes, other potential scoring regions are not provided and, if used in a real game, much of the target is obscured by a real goalie.

In addition to the above-mentioned devices, numerous other practice aids have been developed for hockey and other sports, many of which have been patented around the world. However, none are truly compatible with live action during a real game, nor do they provide sound, positive psychological reinforcement during an actual game when the practice aid is removed.

SUMMARY OF THE INVENTION

In many sports such as hockey wherein players shoot at a goal, the shooter often shoots directly at the goaltender, and not to the open spaces in the goal. This invention addresses this problem by providing a shooting target that uses a visual barrier to train and develop a psychological mind set to improve shooting accuracy during practice and subsequent games. The target may be used during practice, with or without a goaltender, providing a visual target all around the goaltender no matter what position the shooter is in relative to a goaltender's real or imaginary position.

The inventive practice aid is adapted for use with a sports goal having an opening defined by a horizontal upper member with a length and two vertical side members, each with a length, wherein the side members extend up from a ground surface to the upper member, with the area in front of the members being defined as outside of the goal, and the area behind the members being defined as inside the goal. The preferred embodiment comprises a barrier having an upper edge corresponding to the length of the upper member of the goal and two side edges having a length corresponding to the length of the side members of the goal. The barrier further has an inner edge spaced apart from the outer edge defining a width, and a plurality of fasteners for attaching the barrier to the goal such that the barrier is disposed immediately behind the members and inside the goal.

The barrier may be composed of a flexible material or rigid or semi-rigid panels made of plastic or sheet metal. In all embodiments, the barrier is colored with a bright or fluorescent color intended for players to remember after the barrier is removed for practice without the barrier or a real game.

In the preferred embodiment, the barrier is comprised of a flexible material with stiffening members disposed along at least the inner edge of the flexible material. The barrier may be constructed from three separate panels, comprising two side panels and an upper panel, which are sewn, glued or otherwise joined in abutting or overlapping fashion. The width of the barrier is in the range of 2 to 12 inches and, for ice hockey, preferably in the range of 5 to 6 inches.

Thus, when installed, the barrier forms what amounts to an upside-down U shape with two bottom edges at or above the ice or ground surface. For example, the bottom edges are spaced apart from the ground surface so as not to interfere with the movements of a goal tender. Stiffening members may be disposed along each bottom edge. The stiffening members may be solid or hollow plastic or metal rods in casings which are sewn shut. The upper edge of the barrier includes a central notch to accommodate a central goal pipe. The barrier may be sized for various games, with the dimensions being varied to suit the particular sport.

DETAILED DESCRIPTION OF THE INVENTION

This invention resides in apparatus for improving shots on goal. Although details will be presented with respect to hockey goals, the invention is applicable to other sports with dimensional modifications discussed herein below.

Figure 1:
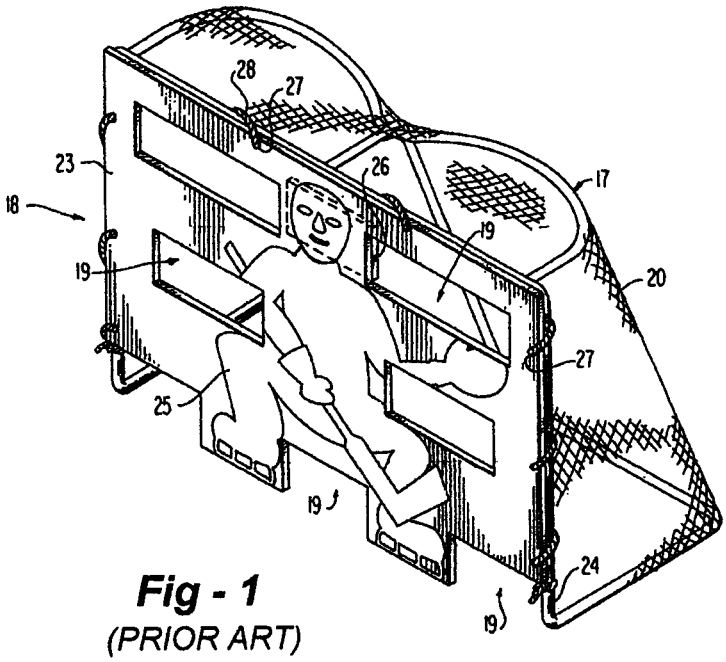
Fig - 1 (PRIOR ART)
FIG. 1 is a drawing of prior art practice target.
Figure 2:
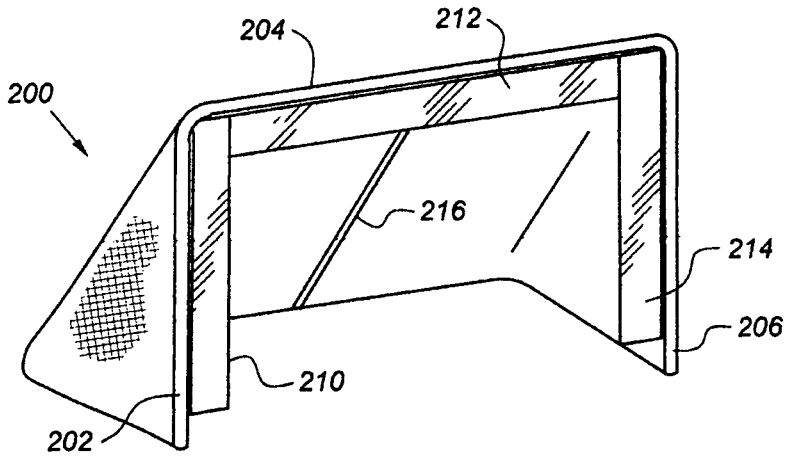
FIG. 2 is an oblique view of the preferred embodiment of the invention.

FIG. 2 is an oblique representation of the preferred embodiment of the invention with respect to a hockey goal 200 having an upper horizontal bar 204 and vertical side bars 202, 206. The invention broadly comprises at least one panel associated with each of the bars of the goal. In particular, left panels 210, 214 attach to side bars 202, 206, and a top panel 212 attaches to top bar 204. Preferred dimensions are provided below with the understanding that the panels, particularly the top panel, may be provided in multiple pieces for easier shipping and/or assembly.

In all embodiments, the panels are made of a brightly colored, preferably fluorescent material, with the goal being to create a memory effect. It is believed that even after the panels are removed for play without them, those trained will remember where the bright/fluorescent color used to be and shoot for those locations. The panels are also preferably made of a flexible material for packing and transport purposes through rigid or semi-rigid panels made of plastic, for example, are not precluded. In the preferred embodiment, each panel is made of a 1000 denier fluorescent fabric.

For regulation hockey applications, the top panel measures 72"×5½" and is made of. Any bright or fluorescent color will suffice particularly blue, green, orange or red. The width of the panel may also vary from 3 to 10 inches, however, depending upon the skill of the players, though 5 to 6" is preferred with 5½" being most preferred.

Figure 3A:
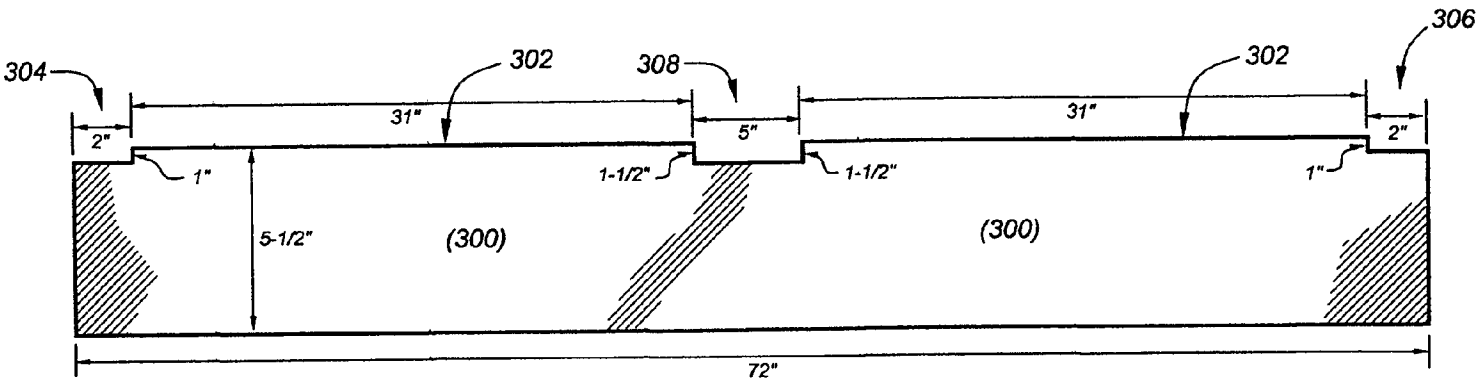
FIG. 3A is a detail drawing of the forward surface of a top panel according to the invention.

As shown in FIG. 3A (note that none of the figures are to scale), the top edge 302 of the top panel 300 is preferably notched at each end (left and right edge) with a measurement of 2"×1" to accommodate the goal pipes. The top edge 302 is also notched in the center with a 5"×1½" notch to accommodate the center goal pipe 216 shown in FIG. 2.

Figure 3B:
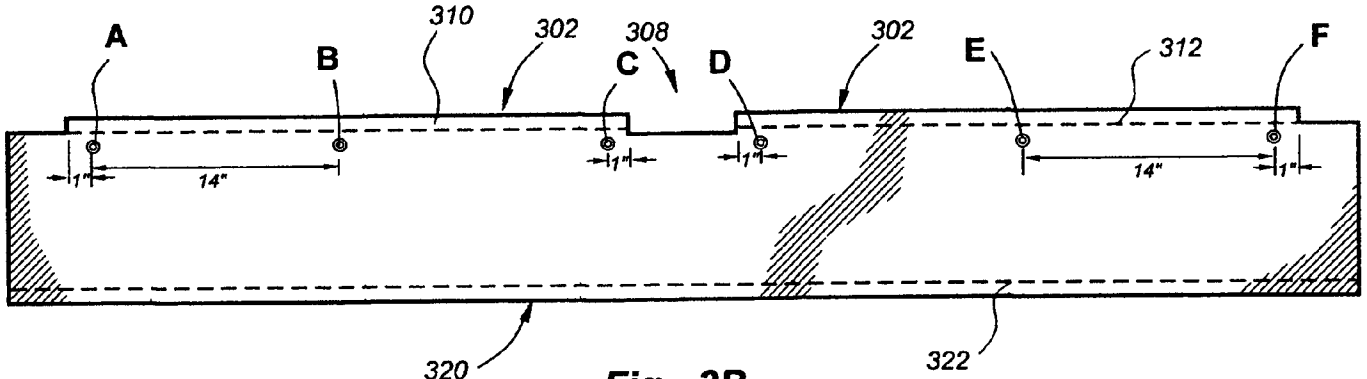
FIG. 3B is a detail drawing of the back surface of the top panel.

As shown in FIG. 3B, ½" casings 310, 312 are made at the top edge of the top panel 30" in length from the left edge and 30" in length from the right edge. Each top casing ends at the central 5"×1" notch. The bottom edge 320 of the top panel has a ½" casing 322 36" in length from the left edge and 36" in length from the right edge. All casings are filled with rods to provide rigidity and strength. In the preferred embodiment ⅜" solid nylon rods are used though other diameters, hollow rods and different materials such as fiberglass or aluminum may be used. Each rod is approximately the length of each casing, and the casings are preferably sewn shut at each end to prevent the rods from sliding out.

Continuing the reference to FIG. 3B, six grommets A-F are provided near the top edge 302. Grommets A, F are placed 1" from the 2"×1" notch on each end and 1" from the Top Edge. A second set of grommets C, D are placed 1" on each side of the central notch 308 and 1" from the top edge. A third set of grommets B, E are placed approx. 16" in length from each end of top edge.

Figure 4A:
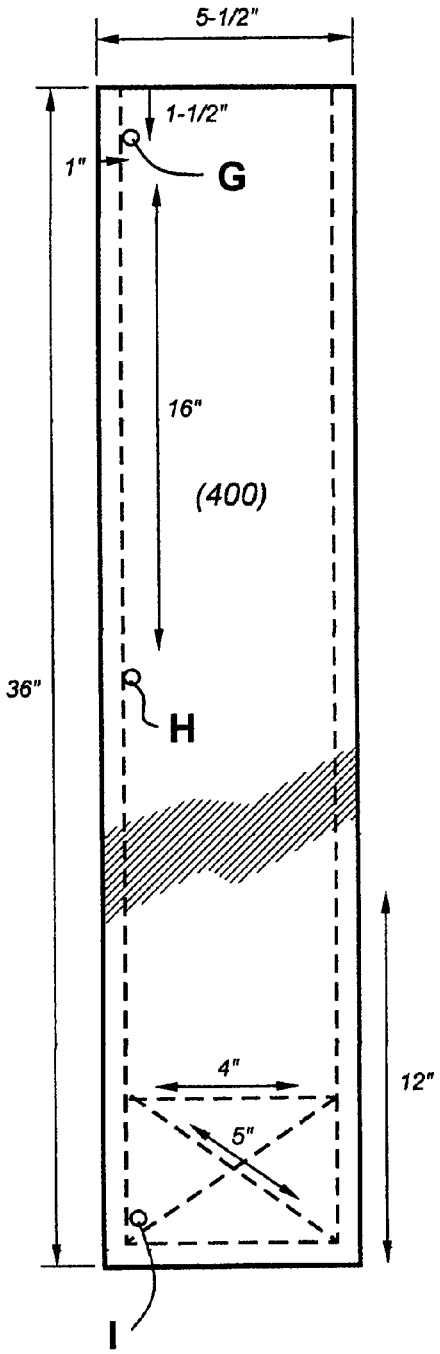
FIG. 4A is a detail drawing of a left side panel according to the invention.
Figure 4B:
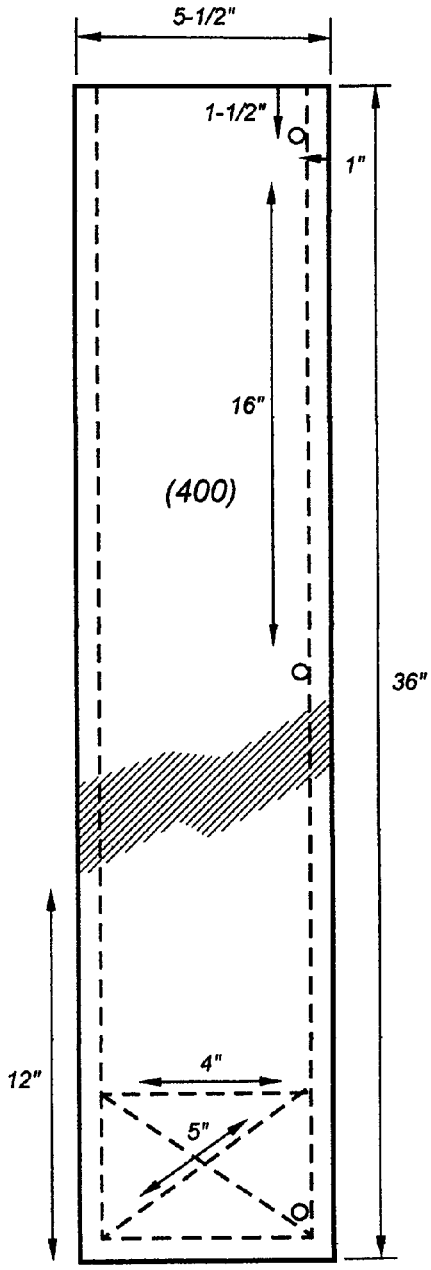
FIG. 4B is a detail drawing of a right side panel according to the invention.

Now referring to FIGS. 4A, B, the left and right panels are mirror images of one another. Both measure 36"×5½", though, as with the top panel, the width of the side panels may vary from 3 to 10 inches, however, depending upon the skill of the players, though 5 to 6" is preferred with 5½" being most preferred. Each side panel has ½" casings on the left and right edges, 33" in length. The bottom edges of both side panels have a ½" casing 5" in length to provide rigidity and strength. The bottom casings receive a 4" rod. As with the top panel, ⅜" solid nylon rods are used though other diameters, hollow rods and different materials such as fiberglass or aluminum may be used. Each rod is approximately the length of each casing, and the casings are preferably sewn shut at each end to prevent the rods from sliding out.

Three ½" grommets (i.e., G, H, I in the left panel) are placed in each side panel as shown. The first grommet is placed 1" from the top edge and the second placed 1" from the bottom edge. Each grommet is 1" from the left edge. The third grommet is placed 16" in length from the top edge and 1" from the left edge, total of three grommets. A 4"×4" cross stitch pattern (i.e., 440 in the left panel) is stitched for reinforcement 2" from the bottom of each panel.

In the preferred embodiment, the various panels are sewn together. That is, the top of the left panel is sewn to the left edge of the top panel, and the top of the right panel is sewn to the top edge and right edge of the top panel providing one U-shaped piece that is attached to the goal with twelve 8" balled bungee cords. Each balled bungee cord, after being threaded through the ½" grommets has attached a ⅜" spring key ring. The spring key rings cause the balled bungee cords to be permanently attached to the panels, thereby preventing the cords from detaching from panels when in use and transporting. The spring key rings also prevent the bungee cords from being completely pulled through the grommets holes.

In use, the attached panels are coupled to the goal by the use of the twelve 8" balled bungee cords, which are wrapped and secured around the goal pipes, providing a valuable visual target for the shooter no matter where the shooter is in relationship to the goaltender. The device is attached to the inside of the goal pipes so as not to interfere with the goaltender's side-to-side movements. With such a configuration, if the shooter hits the device, it will be a goal because the puck is hitting the inside of the pipes causing the puck to ricochet into net. The saying "practice makes perfect" allows the shooter to aim at the fluorescent fabric during practice. If the shooter does it as a matter of habit, the shooter will psychologically visualize the fluorescent fabric during an actual game.

In terms of optional elements, vibration sensors may be added to detect when the projectile hits the target, thereby causing a blinking light or a sound to occur. Another panel may be placed inside the goal along the ice or ground to provide an addition visual extension.

The invention is applicable to any netted sport or goal associated game. Examples but not limited to ice hockey, roller hockey, street hockey, soccer, La Cross, and so forth. The list below identifies the changes in goal dimensions which would be used to accommodate these other sports, with the understating that modification may be in order for younger players.

Soccer: 8 ft tall/24 ft wide
Lacrosse: 6 ft×6 ft
Field hockey: 12 ft wide/7 ft high
Water polo: 58 inches×148 inches

The invention claimed is:

1. A practice aid for a sports goal having two spaced-apart side members extending up from a ground surface to a horizontal upper member, the members defining a goal opening, the practice aid comprising:

three separate panels, including a top panel and two side panels, each panel having a length and opposing, first and second parallel side edges defining a width;

a plurality of fasteners for attaching the first edge of the top panel to the upper member of the goal and the first edge of each side panel to a respective one of the side members of the goal;

each panel being constructed from a flexible material including a pair of stiffening rods running lengthwise along the side edges of each panel, such that the panels assume a generally flattened, upside-down U-shaped barrier parallel to the goal opening when attached, with second edges of the members defining a smaller goal opening for practice purposes with a goal tender.

2. The practice aid of claim 1, wherein the panels are colored with a bright or fluorescent color.

3. The practice aid of claim 1, wherein the width of each panel is in the range of 2 to 12 inches.

4. The practice aid of claim 1, wherein the width of each panel is in the range of 5 to 6 inches.

5. The practice aid of claim 1, wherein:

the side panels have bottom edges when attached; and the bottom edges are spaced apart from the ground surface so as not to interfere with the movements of a goal tender.

6. The practice aid of claim 1, wherein the upper edge of the panel includes a central notch to accommodate a central goal pipe.

7. The practice aid of claim 1, wherein the barrier is sized for a hockey goal, such that the length of the upper edge of the barrier measures about 72 inches, and the two side edges measure about 36 inches.

8. The practice aid of claim 1, wherein the barrier is sized for a soccer goal, such that the length of the upper edge of the barrier measures about 24 feet, and the two side edges measure about 8 feet.

9. The practice aid of claim 1, wherein the barrier is sized for a lacrosse goal, such that the length of the upper edge of the barrier measures about 6 feet, and the two side edges also measure about 6 feet.

10. The practice aid of claim 1, wherein the barrier is sized for a field hockey goal, such that the length of the upper edge of the barrier measures about 12 feet, and the two side edges measure about 7 feet.

11. The practice aid of claim 1, wherein the barrier is sized for a water polo goal, such that the length of the upper edge of the barrier measures about 148 inches, and the two side edges measure about 58 inches.

* * * * *